United States Patent [19]

Philips

[11] 4,201,376

[45] May 6, 1980

[54] ADJUSTABLE CLAMP FOR V-BLOCK

[76] Inventor: Kochukadamthotil V. Philips, 164-10 84th Ave., Jamaica, N.Y. 11432

[21] Appl. No.: 973,520

[22] Filed: Dec. 26, 1978

[51] Int. Cl.[2] ..... B25B 1/20

[52] U.S. Cl. ..... 269/156; 269/164; 269/321 N; 409/903

[58] Field of Search ..... 90/DIG. 18; 269/321 N, 269/152, 154, 155, 156, 164, 86, 87.3, 246

[56] References Cited

U.S. PATENT DOCUMENTS

| | | | |
|---|---|---|---|
| 1,587,682 | 6/1926 | Siegfried et al. | 269/164 |
| 2,455,024 | 11/1948 | Schneider | 269/321 N |

FOREIGN PATENT DOCUMENTS

| | | | |
|---|---|---|---|
| 986446 | 7/1951 | France | 269/156 |

*Primary Examiner*—Robert C. Watson

*Attorney, Agent, or Firm*—Jordan and Hamburg

[57] ABSTRACT

An adjustable clamp for a V-block comprises an integral piece forming two legs, joined together at an acute angle and each having a free end. A first threaded hole is formed through said means on an axis at least approximately bisecting the acute angle. A first externally threaded elongated member extends through the first hole and has its threads engaged by the threads of the first hole. A respective slot is formed in each of the two legs. A respective block is slidably received in each of the slots. Respective second and third threaded holes are formed through the blocks each on an axis at least approximately intersecting the axis of the first hole at points within the acute angle and within an imaginary line extending between the tips of the legs regardless of the position of the blocks in the slots. Respective second and third externally threaded elongated members extend through the second and third holes and have their threads engaged by the threads of the second and third holes.

2 Claims, 2 Drawing Figures

ADJUSTABLE CLAMP FOR V-BLOCK

BACKGROUND OF THE INVENTION AND PRIOR ART STATEMENT

This invention relates to an adjustable clamp for a V-block.

V-blocks and clamps therefor are well-known shop tools, the typical ones being described, for example, at pages 104, 105 and 106 of "The Shop Tool Manual" (STM-74), published by Brown & Sharpe Manufacturing Company, Industrial Products Division, North Kingston, Rhode Island.

The adjustable clamp of the present invention is intended to be used with the same V-blocks with which the prior art clamps are used.

A substantial disadvantage of the prior art clamps is that the clamping members can be adjusted only axially to clamp or release the workpiece but cannot be adjusted translationally, i.e., laterally. This obviously hampers the utility of the clamp.

It is a primary object of the present invention to provide a clamp which is truly adjustable, i.e., in which certain clamping members can be moved translationally.

Other objects and advantages of the invention will be apparent to one skilled in the art from the further description thereof hereinbelow.

Apart from the various clamps disclosed in the aforementioned publication, "The Shop Tool Manual," other exemplary clamps for V-blocks and similar clamping means are disclosed in the following U.S. Pat. Nos.: 1,476,611; 2,371,831; 2,455,024; 2,724,986; 3,094,821; 3,345,061; 3,537,337; and 3,980,287. In none of these are clamping members provided which are translationally adjustable.

SUMMARY OF THE INVENTION

According to the invention, there is provided an adjustable clamp for a V-block, the clamp being adjustable in the sense that clamping members thereof are translationally adjustable. The clamp comprises means forming two legs joined together at an acute angle and each having a free end, a first threaded hole formed through said means on an axis at least approximately bisecting the acute angle, a first externally threaded elongated member extending through the first hole and having its threads engaged by the threads of the first hole, a respective slot formed in each of the two legs, a respective block slidably received in each of the slots, respective second and third threaded holes formed through said blocks each on an axis at least approximately intersecting the axis of the first hole at points within the acute angle and within an imaginary line extending between the tips of the legs regardless of the positions of the blocks in the slots, and respective second and third externally threaded elongated members extending through said second and third holes and having their threads engaged by the threads of the second and third holes. The aforementioned elongated members may also be referred to as "clamping members." Typically, each of the aforementioned legs is angulated.

The invention will now be further described by reference to a specific embodiment thereof as illustrated in the drawings.

Detailed Description of a Preferred Embodiment

Figure 1:
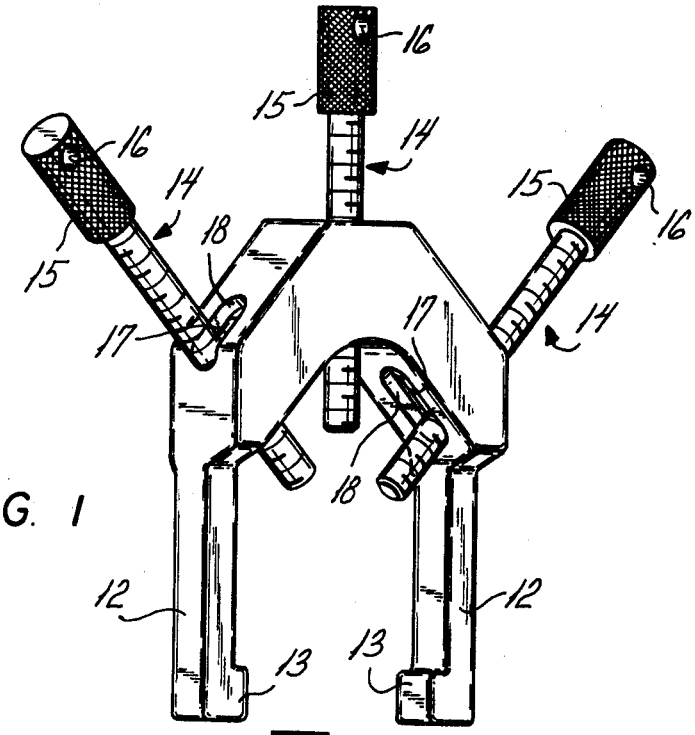
FIG. 1 is an isometric view of an adjustable clamp according to the invention.
Figure 2:
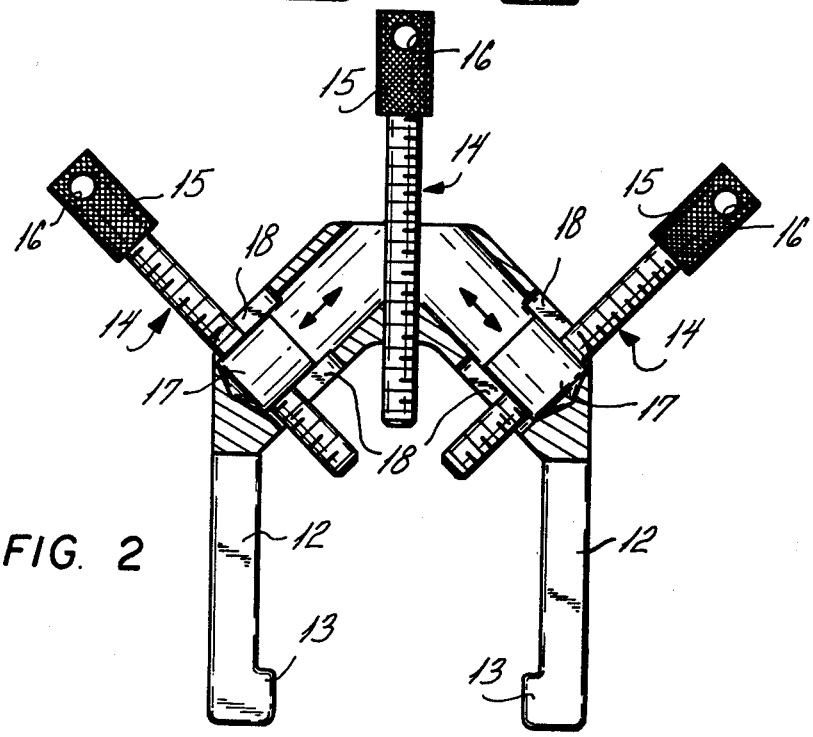
FIG. 2 is a front elevation of the clamp of FIG. 1, partly in section.

The main portion of the adjustable clamp is an integral, symmetrical piece 11. At its plane of symmetry, the two halves of the piece 11 defined by that plane are joined at an acute angle. Each half has an identical leg 12 the free end of each of which is formed as an inwardly turned foot 13. An internally threaded hole is formed through the center of the piece 11 and received in that hole is an externally threaded elongated clamping member 14, the external threads of the clamping member 14 engaging the internal threads of the hole in which it is received whereby the clamping member 14 may be axially adjusted by twisting it into and out of the hole. To facilitate such operation the member 14 is provided with a knurled grip 15 which may conveniently be rotated between one's thumb and forefinger. Moreover, the grip 15 is provided with a radial bore 16 through it. A screwdriver shaft or other elongated member may be inserted in the hole 16, affording the user leverage when tightening down the member 14 onto a workpiece in a V-block. Two additional identical members 14 are provided on each mirror-image half of the clamp. However, these are translationally adjustable because the threaded hole in which each is received is formed in a respective block 17 slidably mounted in a respective slot 18.

Each block 17 is slid to its desired position and then any one or more clamping members 14 are tightened down on the workpeice in a V-block in conjunction with which the clamp is used. It will be observed that in the particular clamp herein illustrated the central clamping member is on an axis at least approximately bisecting the aforementioned acute angle and that the axes of the other two clamping members at least approximately intersect the axis of the central clamping member at points within the aforementioned acute angle and within an imaginary line extending between the tips of the legs of the clamps regardless of the positions of the blocks in the slots. Of course, this characterization would be equally true if one were to speak of the axes of the threaded holes rather than the axes of the clamping members since the clamping members are coaxial with the threaded holes in which they are received. While the invention has been described by reference to a specific, preferred embodiment thereof, it is to be understood that the hereto appended claims are intended also to encompass all obvious modifications and variations thereof.

What I claim is:

1. An adjustable clamp for a V-block comprising means forming two legs joined together at an acute angle and each having an inwardly directed free end slidably positionable in the V-block, a first threaded hole formed through said means on an axis at least approximately bisecting said acute angle, a first externally threaded elongated member extending through said first hole and having its threads engaged by the threads of the first hole, a respective slot formed in each of the two legs at a location remote from the free end thereof, a respective block slidably received in each of the slots, respective second and third threaded holes formed through said blocks each on an axis at least approximately intersecting the axis of the first hole at points within the acute angle and within an imaginary line extending between the tips of the legs regardless of the positions of the blocks in the slots, and respective second and third externally threaded elongated members extending through said second and third holes and having their threads engaged by the threads of the second and third holes, whereby a workpiece of any cross section can be held rigidly on the V-block by the three elongated members.

2. An adjustable clamp according to claim 1, in which each of the legs is bent and the legs are connected together at the uppermost end thereof.

* * * * *